US006892561B2

(12) United States Patent
Grell

(10) Patent No.: US 6,892,561 B2
(45) Date of Patent: May 17, 2005

(54) APPARATUS FOR STRIP PROCESSING

(75) Inventor: Jürgen Grell, Neuss (DE)

(73) Assignee: Aluminium Norf GmbH, Neuss (DE)

( * ) Notice: Subject to any disclaimer, the term of this patent is extended or adjusted under 35 U.S.C. 154(b) by 0 days.

(21) Appl. No.: 10/312,426

(22) PCT Filed: Jun. 28, 2001

(86) PCT No.: PCT/EP01/07358

§ 371 (c)(1),
(2), (4) Date: Jun. 10, 2003

(87) PCT Pub. No.: WO02/000365

PCT Pub. Date: Jan. 2, 2003

(65) Prior Publication Data

US 2004/0035173 A1 Feb. 26, 2004

(30) Foreign Application Priority Data

Jun. 29, 2000 (DE) ..... 100 31 728

(51) Int. Cl.[7] ..... B21D 1/02
(52) U.S. Cl. ..... 72/183; 72/160
(58) Field of Search ..... 72/183, 161, 160, 72/167, 168

(56) References Cited

U.S. PATENT DOCUMENTS 2,337,047 A * 12/1943 Hunter ..... 72/179
2,969,826 A * 1/1961 Allen et al. ..... 72/176
3,006,401 A 10/1961 Wognum et al.
3,021,737 A * 2/1962 Titze ..... 72/366.2
3,055,241 A * 9/1962 Hedgecock et al. ..... 72/205
3,680,343 A 8/1972 Singleton et al.
3,854,315 A 12/1974 Winkler
4,033,165 A * 7/1977 Arimura et al. ..... 72/205
4,329,863 A * 5/1982 Pryor et al. ..... 72/205
5,341,664 A * 8/1994 Noe et al. ..... 72/161

FOREIGN PATENT DOCUMENTS

DE 1752306 5/1971
JP 04138805 5/1992

* cited by examiner

*Primary Examiner*—Daniel C. Crane
(74) *Attorney, Agent, or Firm*—Proskauer Rose LLP

(57) ABSTRACT

The invention relates to an apparatus for strip processing with at least one uncoiling station, at least one strip processing station (1) and at least one coiling station. Especially to reduce undesirable strip-edge stresses, a known apparatus for strip processing is configured such that a strip-edge stretching station (2) which stretches the edges of the strip, is provided between the uncoiling station and the coiling station.

2 Claims, 3 Drawing Sheets

APPARATUS FOR STRIP PROCESSING

BACKGROUND OF THE INVENTION

The invention relates to an apparatus for strip processing with at least one uncoiling station, at least one strip processing station and at least one coiling station.

Such apparatus are known in a plurality of configurations. If the strip processing consists in trimming a strip, for example, the strip is uncoiled from a coil in an uncoiling station, fed to the trimming station, trimmed by a trimming knife in the trimming station and then coiled onto a coil by a coiling station. In addition to trimming, generic devices for strip processing are also used for parting, cold rolling or the like.

During the manufacture of a strip, this strip is generally subjected to a plurality of roll passes. Over the majority of the strip width, the reduction in thickness during rolling leads to an increase in the length of the strip. Near the strip edges however, in addition to the effect of increasing strip length during rolling, there is also an increase in strip width. As a result of the increase in the width of the strip at the strip edge, less material is available for the increase in the strip length at the strip edge which has the result that a more or less high strip-edge stress appears in the strip. The strip-edge stress described results in various problems during further processing of the strip. During the manufacture of can-body strip, for example, which is processed to form drink-can bodies in further processing steps, as a result of the generally very high strip-edge stress in this strip, undesirable edge lengthening occurs during trimming as a result of friction of the cut edges on the trimming knife. This undesirable edge lengthening leads, on the one hand, to a so-called starburst or star pattern formation on the coiled coil and, on the other hand, results in poor machinability during the further processing.

Occasionally during the further processing of so-called can-lid strip some strip cracking occurs during the stretching carried out during the further processing, which may have its origin, among other things, in the fact that the strip edges of the can-lid strip supplied for further processing have a high strip-edge stress and thus favour cracking during stretching.

Finally, a high strip-edge stress during the rolling process has the result that during each roll pass, a higher rolling energy must be applied to overcome the strip-edge stress than would be needed if this strip-edge stress were completely reduced. Thus, if the strip-edge stress can be reduced during two passes, the rolling energy required on the second pass is reduced.

SUMMARY OF THE INVENTION

On the basis of the prior art described previously, the object of the invention is to provide an apparatus for strip processing which makes it possible to achieve a specific reduction in the strip-edge stress in a strip.

The object derived and indicated previously is solved according to the invention by providing between the uncoiling station and the coiling station, a strip-edge stretching station to stretch the edges of the strip. The strip-edge stretching station according to the invention offers the possibility of reducing the strip-edge stress to the desired extent or even specifically producing a strip-edge overstretching. By specifically reducing the strip-edge stress, the problems during strip processing known from the prior art, as described above, can be reduced or even completely eliminated.

The apparatus for strip processing according to the invention is especially suited to the processing of strips of aluminium materials since particularly high strip-edge stresses occur during the cold rolling of aluminium because of the strain-hardening properties of aluminium.

In the apparatus for strip processing according to the invention, the strip processing can especially consist exclusively in stretching the edges of the strip. However, it is generally advantageous to combine the stretching of the strip edges with at least one further processing step, for example, trimming the strip, in an apparatus for strip processing.

A possibility for constructing a strip-edge stretching station according to the invention would consist, for example, in subjecting the strip edges to a separate pass which preferably comprises no processing of the strip between the strip edges. It may be feasible to have an arrangement of two short rollers in the area of the strip edges which, for example, specifically roll the strip edges in cooperation with a guide roller in the rolling mill whereby the strip-edge stresses are reduced.

In practical testing it has proved to be particularly advantageous to have a configuration of the apparatus for strip processing according to the invention in which the strip-edge stretching station has two strip-edge stretching units which engage laterally into the strip and one strip-edge stretching unit which respectively has at least three strip-edge guide rollers. In such a strip-edge stretching station the strip edges are straightened not by running directly between the strip-edge guide rollers in the direction of strip transport but by being guided over the strip-edge guide rollers in a loop which results in stretching of the strip edges on account of the increased path length for the strip edges. The structure of such a strip-edge stretching station is very simple and can easily be integrated in existing apparatus for strip processing.

Since, according to a development of the invention, the strip-edge guide rollers can be adjusted with respect to one another substantially perpendicular to the plane of the strip, the loop forced over the strip-edge guide rollers can be adjusted whereby the degree of stretching is in turn adjustable.

If, according to a further development of the invention, the strip-edge guide rollers are constructed as truncated-cone-shaped, on the one hand the threading of the strip edges between the strip-edge guide rollers is simplified and on the other hand, it is ensured that an increasing stretching takes place towards the edge of the strip, whereby account is taken of the stress gradient in the strip edge. Naturally, other thickness profiles are also feasible for the strip-edge guide rollers, which are respectively matched to the desired stretching profile.

Since the strip-edge stretching devices are arranged in the plane of the strip, displaceable perpendicular to the strip running direction, the depth of immersion of the strip-edge guide rollers in the strip can be adjusted and thus the area of the strip edges which is stretched can be varied.

BRIEF DESCRIPTION OF THE DRAWINGS

There are now a plurality of possibilities for configuring and further developing the apparatus for strip processing according to the invention. For this purpose reference is made, on the one hand, to the subsidiary claims to claim 1 and on the other hand, to the description of an embodiment in connection with the drawings, wherein

DETAILED DESCRIPTION OF THE INVENTION

Figure 1:
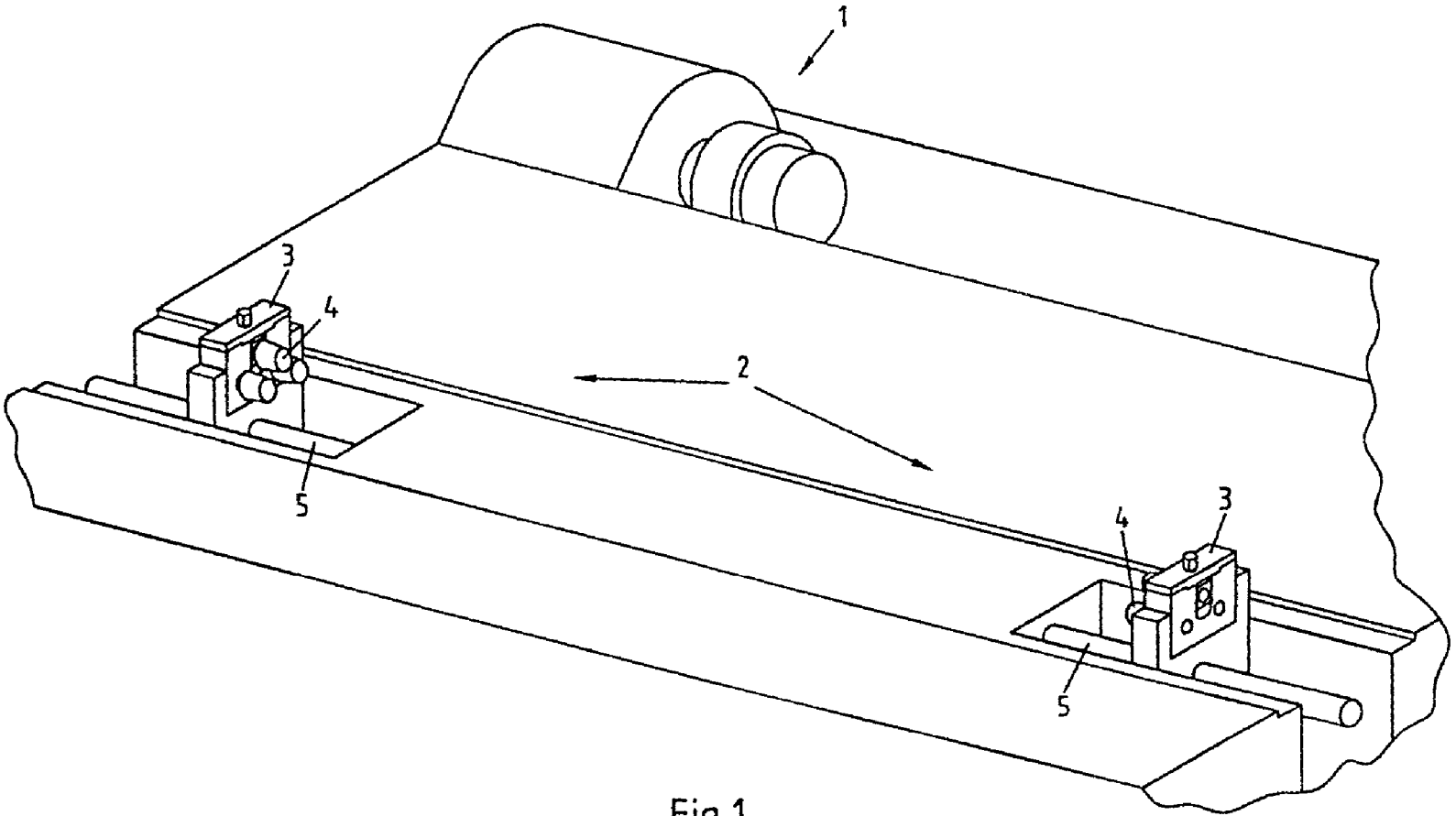
FIG. 1 is a perspective view of a section of an apparatus for strip processing according to the invention with a strip-edge stretching station.

The section of an apparatus for strip processing according to the invention shown in FIG. 1 shows neither an uncoiling station nor a coiling station whose construction is however inherently known. Among other things, roller shears 1 for trimming a strip not shown, is shown as the strip processing station. According to the invention, between the uncoiling and coiling stations which are not shown, there is a strip-edge stretching station 2 which stretches the strip edges of a strip, also not shown.

As can be seen from FIG. 1, the strip-edge stretching station 2 has two strip-edge stretching units 3 which engage laterally into the strip not shown, wherein each of the strip-edge stretching units 3 has three strip-edge guide rollers 4 which are only partly visible in FIG. 1.

FIG. 1 also shows that the strip-edge stretching units are arranged displaceably on guides 5 in the plane of the strip perpendicular to the strip running direction. In the embodiment shown in FIG. 1 the strip-edge stretching units 3 are displaced manually on the guides 5. Alternatively, it is easily feasible that the strip-edge stretching units can be fed automatically on suitable guides with a suitable drive.

Figure 2:
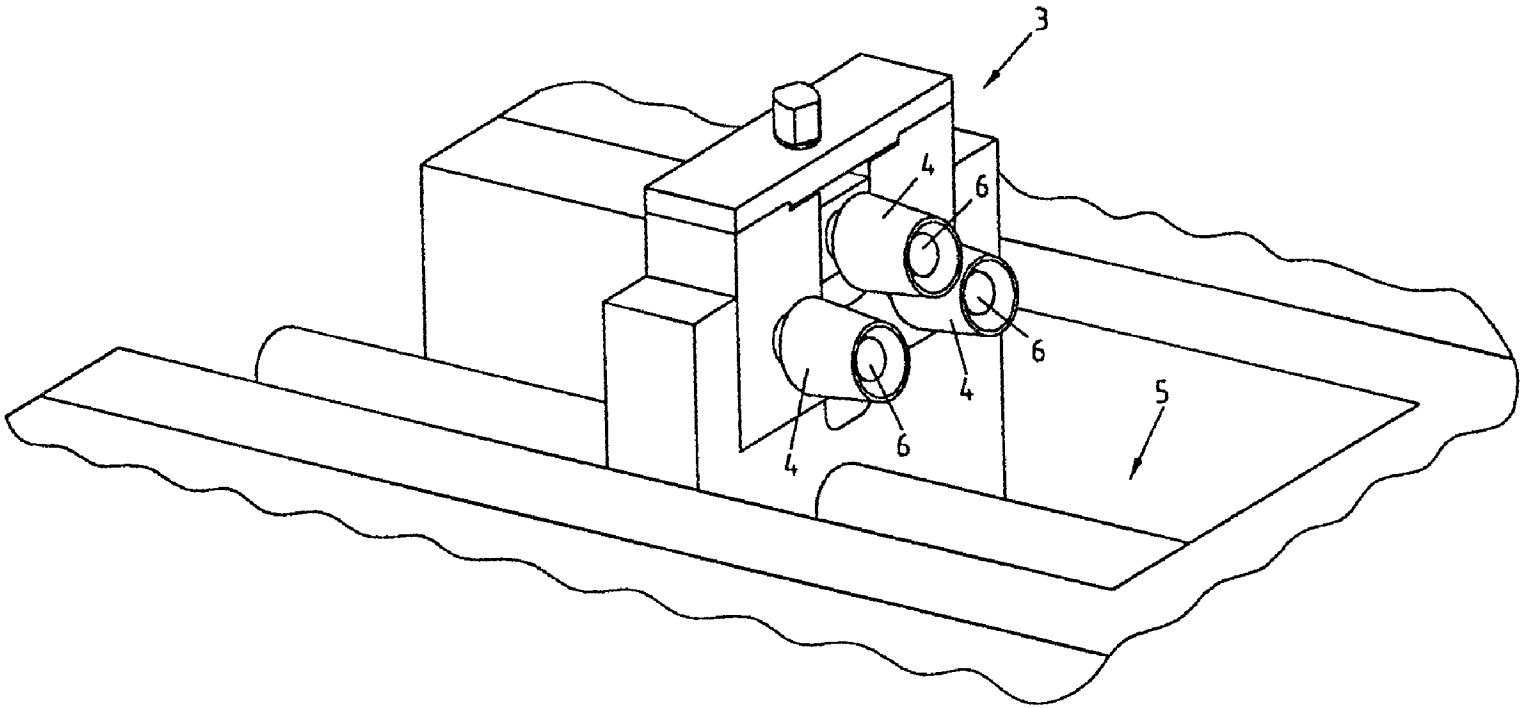
FIG. 2 is a perspective view of an embodiment of a strip-edge stretching unit.
Figure 3:
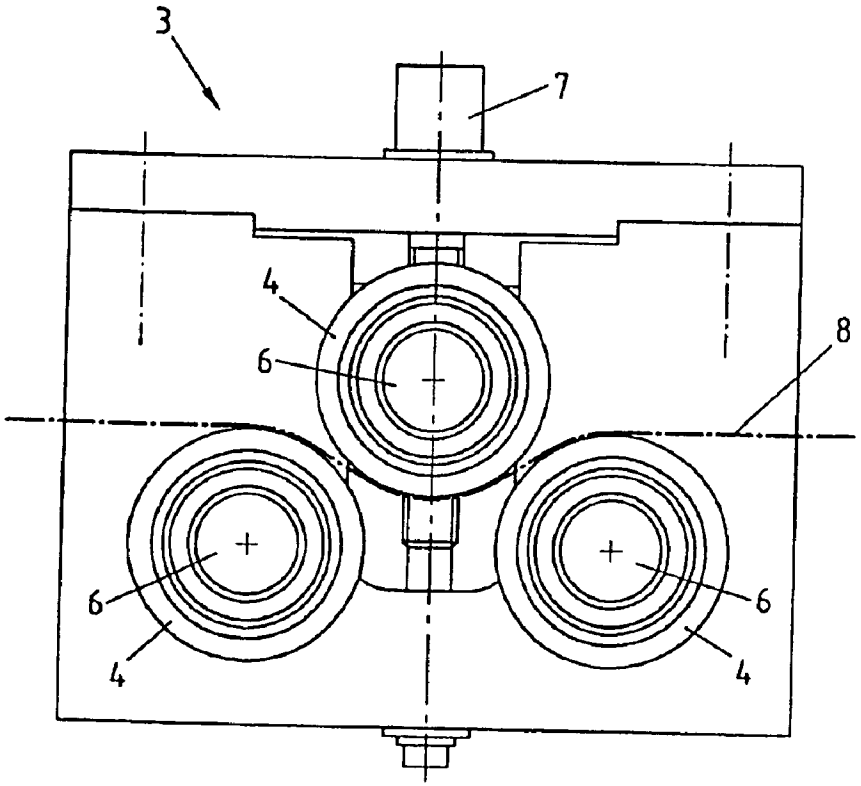

FIG. 2 shows a strip-edge stretching unit 3 in an enlarged perspective view. The three strip-edge guide rollers 4, the roller shafts 6 and part of a guide 5 can be seen especially clearly in FIG. 2. It can be seen from the diagram in FIG. 3 that the immersion depth of the uppermost strip-edge guide roller 4 can be adjusted with respect to the lower of the strip-edge guide rollers 4, i.e., perpendicular to the plane of the strip, by means of an adjusting screw 7. The loop in which the strip 8 shown by the dot-dash line in FIG. 3 runs through the strip-edge stretching unit 3 is adjusted via this immersion depth.

Figure 4:
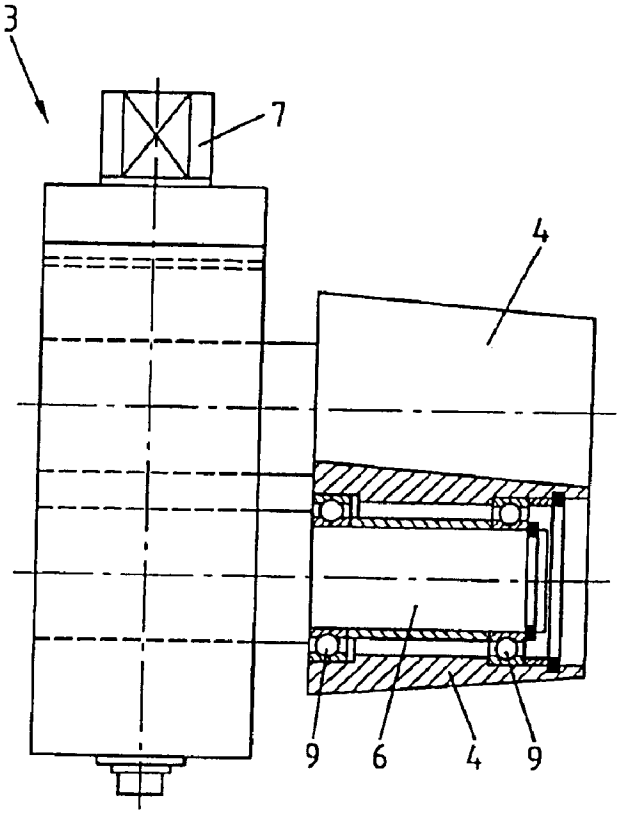
FIG. 3 is an embodiment of a strip-edge stretching unit viewed from the top in the direction of the strip width and FIG. 4 is a part cutaway view of the embodiment of the strip-edge stretching unit in the strip running direction.

Seen from the strip running direction, FIG. 4 shows particularly clearly that the strip-edge guide rollers 4 are constructed as truncated-cone-shaped which results in a different degree of stretching of the strip edge depending on the distance from the edge of the strip. It can also be seen from FIG. 4 that the strip-edge guide rollers 4 are preferably supported by means of two bearings 9 with respect to the roller shaft 6 in order to take up the not inconsiderable radial forces during transport of the strip.

What is claimed is:

1. Apparatus for processing an elongated metal strip passing through said apparatus along a strip running direction, comprising, at least one uncoiling station, at least one strip processing station, at least one coiling station, wherein the strip processing station includes a strip-edge stretching station disposed between the uncoiling station and the coiling station for stretching the lateral edges of the strip, said strip-edge stretching station comprising at least two strip-edge stretching units each of which is disposed along and engages a lateral edge of said strip, each of said strip-edge stretching units comprising at least three strip-edge guide rollers, said strip-edge guide rollers being adjustable with respect to one another substantially perpendicularly to a plane of said strip, said strip-edge guide rollers being in the form of truncated cones, said strip-edge stretching units being arranged such that they can be displaced perpendicularly with respect to the strip running direction.

2. Method for processing an elongated metal strip passing through an apparatus for processing said strip along a strip running direction, comprising uncoiling said strip at at least one uncoiling station, coiling said strip at at least one coiling station, and stretching the lateral edges of said strip at a strip-edge stretching station located between said uncoiling station and said coiling station, said strip-edge stretching station comprising at least two strip-edge stretching units each of which is disposed along and engages a lateral edge of said strip, each of said strip edge stretching units comprising at least three strip-edge guide rollers, said strip-edge guide rollers being adjustable with respect to one another substantially perpendicular to a plane of said strip, said strip-edge guide rollers being in the form of truncated cones, said strip-edge stretching units being displaceable perpendicularly with respect to the strip running direction, said lateral edges of said strip being stretched by passing said lateral edges around said strip-edge guide rollers.

* * * * *